United States Patent [19]

Fiedler et al.

[11] Patent Number: 4,810,172

[45] Date of Patent: Mar. 7, 1989

[54] GAS-OPERATED POSITIVE DISPLACEMENT PUMP

[75] Inventors: Robert R. Fiedler, Lincoln; Louis F. Lederer, Seward, both of Nebr.

[73] Assignee: Isco, Inc., Lincoln, Nebr.

[21] Appl. No.: 103,805

[22] Filed: Oct. 1, 1987

[51] Int. Cl.[4] ..... F04B 43/10

[52] U.S. Cl. ..... 417/394; 417/478

[58] Field of Search ..... 417/394, 478

[56] References Cited

U.S. PATENT DOCUMENTS

| | | | |
|---|---|---|---|
| 4,111,613 | 9/1978 | Sperry | 417/394 |
| 4,334,640 | 6/1982 | Overbruggen et al. | 417/394 X |
| 4,360,320 | 11/1982 | Owen | 417/394 X |
| 4,492,535 | 1/1985 | Stahlkopf | 417/394 |
| 4,705,461 | 11/1987 | Clements | 417/388 |

*Primary Examiner*—Leonard E. Smith

*Attorney, Agent, or Firm*—Vincent L. Carney

[57] ABSTRACT

To pump liquid using a source of gas pressure, a gas-operated positive displacement pump includes an outer tubular rigid wall and an inner movable wall forming a cylindrical liquid chamber which communicates with a liquid inlet and a liquid outlet, both including check valves to permit liquid to flow into the liquid chamber through the liquid inlet and out of the liquid chamber through the liquid outlet only. Within the cylindrical liquid chamber, is a tubular gas chamber formed of an elastomeric wall capable of contacting the movable wall of the liquid chamber to compress it to cause liquid to leave and pull it back to draw liquid into the chamber, the inner air chamber being adapted to receive gas under pressure and then vented to the atmosphere alternatively. Gas between the movable wall and elastomeric wall may be squeezed into the gas chamber and held there to form a vacuum connection between the movable wall and elastomeric wall.

17 Claims, 3 Drawing Sheets

GAS-OPERATED POSITIVE DISPLACEMENT PUMP

BACKGROUND OF THE INVENTION

This invention relates to gas-operated positive displacement pumps.

Gas-operated pumps are known in which gas under pressure moves a wall of a gas chamber against a liquid chamber to squeeze the liquid chamber and thus expel liquid through an outlet. In such gas-operated pumps, the gas is alternatively pressurized and depressurized to squeeze the liquid chamber and expel liquid through a check valve at an outlet port of the pump while the inlet port is blocked and then to permit the liquid chamber to expand so new liquid enters it through an inlet port and inlet check valve.

One prior art pump of this general class is disclosed in U.S. Pat. No. 4,295,801. This patent discloses a pump having an elongated cylindrical body with a reciprocating, gas-driven piston within it to pump liquid from a liquid chamber. In this prior art pump, the piston is driven by expansion of gas chambers and the movement of the piston in pumping liquid switches the pressurized gas from one gas chamber to another to drive the piston in a reciprocating motion.

This prior art type of gas-operated positive displacement pump has a disadvantage in that it is expensive and contains a large number of parts, any one of which may malfunction or clog.

Another prior art type of gas-operated pump of this class is disclosed in U.S. Pat. No. 4,489,779 in which air under pressure is applied directly to the walls of a liquid tube to squeeze it so that it expels fluid. This prior art pump has a central liquid tube which is alternately filled by the hydrostatic head of water surrounding the pump and squeezed to expel water.

This prior art type of pump has a disadvantage in that it only operates in a satisfactory manner when positioned at great depth such as 10 feet so that it has sufficient hydrostatic head to refill the squeezed fluid chamber.

Still another type of prior art pump has been sold by Isco, Inc., 531 Westgate Boulevard, Lincoln, Neb., under the designation, Model 2600 pump. In this pump, air under pressure is alternately applied and removed from a central silicone rubber tube which is circumscribed by a stainless steel cylinder. Water is admitted into a location between the stainless steel cylinder and the expandable silicone rubber so that the alternating pressurizing and relaxing of the silicone rubber pumps liquid out of the pump. Because the silicone rubber is stretched, it snaps back and draws liquid into the liquid compartment, thus enabling it to pump with low hydrostatic pressure surrounding the pump inlet.

The prior art type of pump has a disadvantage in that the elastomeric silicone rubber is not sufficiently inert or chemically unreactive and thus may be damaged by corrosive liquids or hydrocarbon based liquids present in the water being pumped. Also, the silicone rubber may absorb or adsorb some constituents of the water sample thus lowering their concentration in the sample. These constitutents may later desorb which would again give a non-representative concentration of those constituents in the sample taken.

SUMMARY OF THE INVENTION

Accordingly, it is an object of the invention to provide a novel gas-operated positive displacement pump.

It is a further object of the invention to provide a novel gas-operated pump which is capable of pumping while under low hydrostatic pressure.

It is a still further object of the invention to provide a novel gas-operated positive displacement pump in which the liquid chamber is composed entirely of inert materials.

It is a still further object of the invention to provide a novel gas-operated positive displacement pump which has high flow-rate capabilities and is still durable.

In accordance with the above and further objects of the invention, a gas-operated positive displacement pump includes: (1) a gas chamber having at least a portion of it formed of an elastomeric material; (2) a liquid chamber having one rigid side and one flexible side, with the flexible side being positioned adjacent to the elastomeric material of the gas chamber for movement toward and away from the rigid side; and (3) means for alternately changing the pressure from a high value to a low value within the gas chamber, whereby liquid is pumped from the liquid chamber. In this specification, elastomeric material is considered a material which can undergo a large percentage strain above 50 percent and typically 200 percent before the elastic limit is reached. Flexible material is a material which can fold or bend without breaking.

The area of the contacting surfaces of elastomeric material and the flexible wall of the liquid chamber is at least four square centimeters. The space between the elastomeric material and the flexible wall of the liquid chamber communicates an intermediate chamber through a check valve during expansion of the elastomeric materials. The intermediate chamber communicates with the gas chamber through a second check valve during contraction of the elastomeric material.

In another embodiment, an expandable membrane and a first end of a spring-biased stainless steel piston extend into the chamber of a water cylinder and a second end of the piston extends into a gas chamber. The second end of the piston is moved by pressurized gas so that as gas pressure changes in the gas chamber, the piston moves upwardly and downwardly to pull and push the membrane and thus to pump liquid.

From the above description, it can be understood that the gas-operated positive displacement pump of this invention has several advantages such as: (1) it is simple in construction, containing few movable parts; (2) it is capable of high rates of pumping; (3) it is durable with few wearing parts; (4) it is capable of pumping liquid while only immersed to a shallow depth since it is capable of drawing liquid into the liquid chamber as well as forcing liquid out of the liquid chamber; and (5) the liquid chamber may be composed of inert materials such as stainless steel or polytetrafluoroethylene.

SUMMARY OF THE DRAWINGS

The above noted and other features of the invention will be better understood from the following detailed description when considered with reference to the accompanying drawings in which.

DETAILED DESCRIPTION

Figure 1:
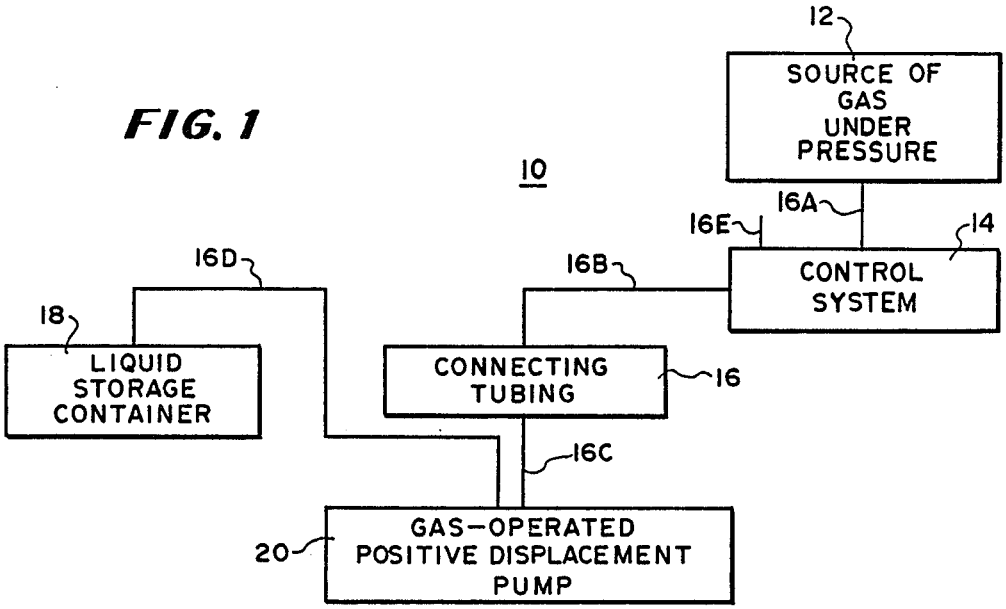
FIG. 1 is a block diagram of a pumping system in accordance with the invention.

In FIG. 1, there is shown a pumping system 10 having a source of gas under pressure 12, a control system 14, certain connecting tubing 16, a liquid storage container 18 and a gas-operated positive displacement pump 20. The gas-operated positive displacement pump 20 communicates: (1) with the source of gas under pressure 12 through connecting tubing 16C, the control system 14 and connecting tubing 16A; and (2) with the liquid storage container 18 through outlet tubing 16D.

To pump liquid, the control system 14 alternately pressurizes and depressurizes the gas-operated positive displacement pump 20 by connecting it alternately to gas under pressure through connecting tubing 16A and 16C from the source of connecting tubing 16 and to atmosphere through the vent tube 16E. With this arrangement, liquid is pumped through the outlet tubing 16D into the liquid storage container 18.

The gas-operated positive displacement pump 20 is capable of receiving liquid by drawing it inwardly by vacuum suction into a chamber made of inert materials and pumping the liquid out from the chamber under pressure. Generally, the inert materials are stainless steel or Teflon (a trademark of DuPont Corporation for polytetrafluoroethylene) or equivalent inert materials which are relatively non-elastomeric. The best materials from the viewpoint of being inert are generally not suitable for stretching any substantial distance and resiliently snapping back under load.

This is because such materials may: (1) reach their yield point at too low a strain for efficient operation within the range of strain before reaching the yield point; or (2) not be able to exert sufficient pressure when gas is released from the gas chamber as it returns to its original unstressed size. For example, Teflon (polytetrafluoroethylene) and stainless steel are not suitable materials.

In the preferred embodiment, the gas-operated positive displacement pump 20 has a diameter of approximately 44 millimeters and a length of approximately 1,219 millimeters. It operates on a gas pressure substantially within the range of 20 pounds per square inch and 120 pounds per square inch.

Figure 2:
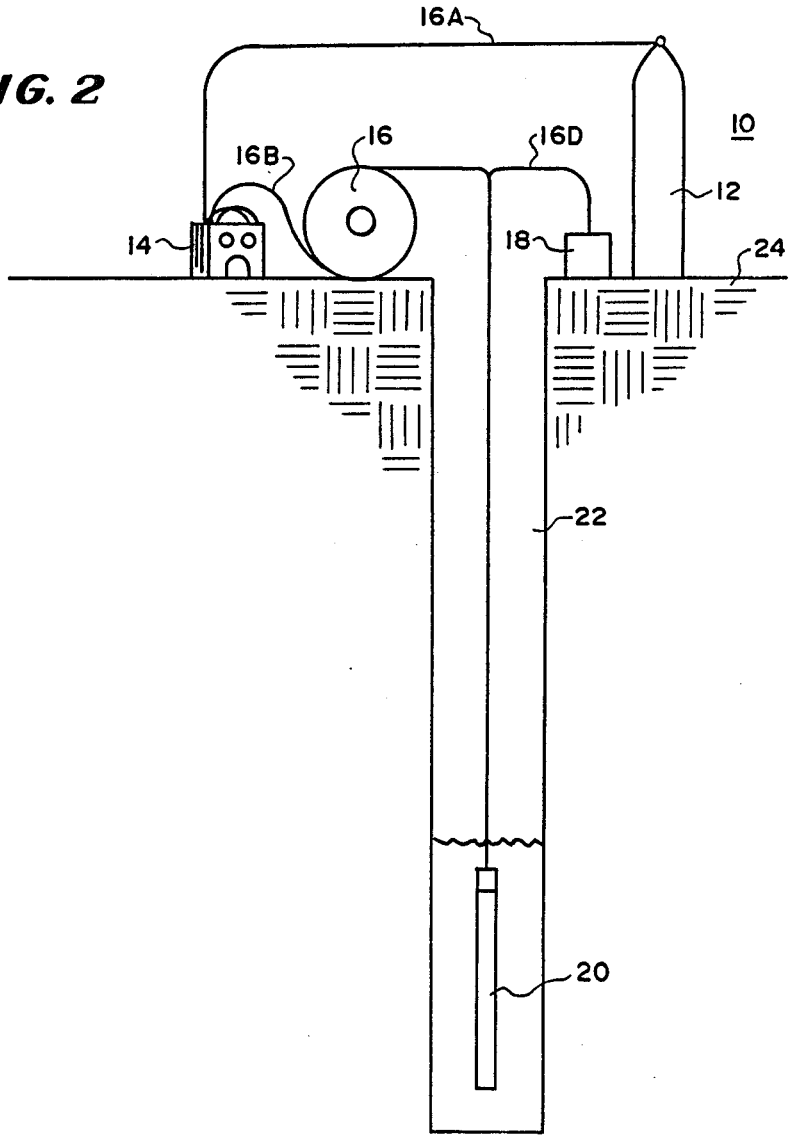
FIG. 2 is a schematic diagram showing one manner in which the pumping system of FIG. 1 is utilized.

In FIG. 2, there is shown a schematic diagram illustrating one application of the gas-operated positive displacement pump 20. In this use of the gas-operated positive displacement pump 20, it communicates through the connecting tubing 16 through a control box containing the control system 14 and the connecting tubing 16C to force liquid upwardly from a well 22 to the liquid storage container 18 under pressure from a pressurized source of gas 12. With this arrangement, liquid may be pumped from a well under ground 24 such as for sampling the quality of water or other purpose. While this pump is shown as a well sampling pump, it may be used for any other purpose such as for sampling sewage or for pumping other liquids or for pumping.

Figure 3:
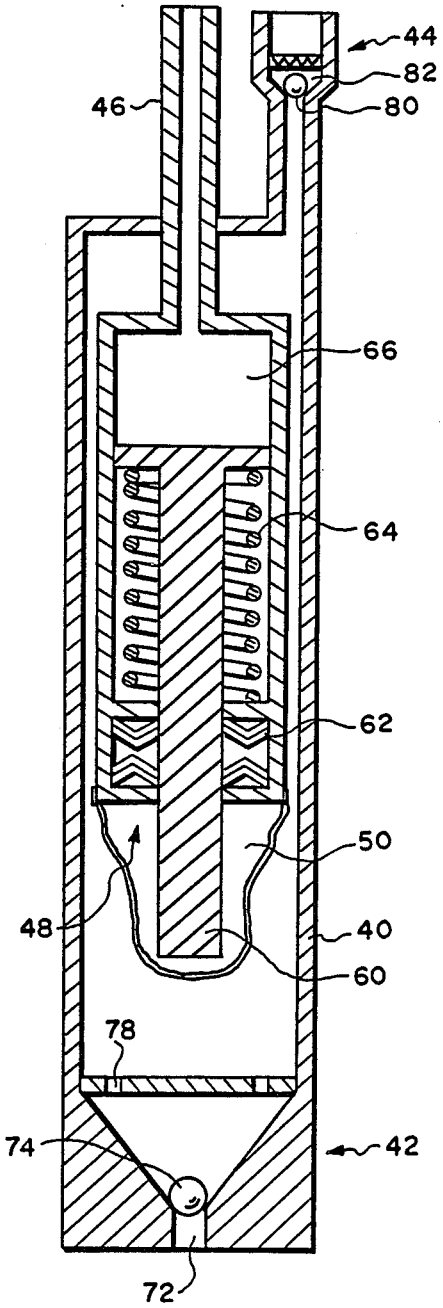
FIG. 3 is an elevational sectional view of one embodiment of pump utilized in the pumping system of FIG. 1.

In FIG. 3, there is shown one embodiment of gas-operated positive displacement pump 20A having an outer wall cylindrical 40, a lower check valve assembly 42, an upper check valve assembly 44, an gas outlet-inlet assembly 46 and a liquid chamber or cylinder (hereinafter referred to as "liquid chamber 50").

In the embodiment of the gas-operated positive displacement pump 20A, a steel piston assembly 48 is actuated by gas through the gas outlet-inlet assembly 46 which alternately forces a piston and membrane into the liquid chamber 50 and withdraws it to alternately pull liquid into the pump 20A through the lower check valve assembly 42, and out of the pump 20A through the upper check valve assembly 44. The embodiment of the gas-operated positive displacement pump 20A is not a preferred embodiment because, while it operates well to draw liquid in and pump it out using wetted parts that are suitably inert, it has a disadvantage. That disadvantage is that the Teflon seals around the solid piston wear in too short a time and require replacement.

The steel piston assembly 48 includes a piston 60, a seal 62 separating the gas chamber 66 from the liquid chamber 50, a membrane 51, and a compression spring 64 which biases the piston 60 upwardly. With this structure, gas in the gas chamber 66 forces the piston 60 downwardly to cause liquid to be pumped upwardly through the upper check valve assembly 44 and, when the gas is vented, causes the piston 60 to move upwardly to draw further liquid through the inlet 72.

The membrane 51 is flexible, inert and surrounds the piston 60 within the liquid chamber 50, thus permitting the piston 60 to be of a less inert material. The membrane may be, for example, Teflon and the piston ordinary steel. It is sealed to the piston assembly 48 and capable of folding and unfolding to prevent liquid from entering the gas chamber 66.

The lower check valve assembly 42 includes a housing 70, a liquid inlet 72, terminating in a valve element seat, a ball valve member 74 and has a plurality of opening 78 to permit liquid to flow in through the liquid inlet 72 into the liquid chamber 50 but not from the liquid chamber 50 through the liquid inlet 72.

With this arrangement, when the piston 60 is forced upwardly by the compression spring 64, the vacuum in the liquid chamber 50 causes liquid to flow through the liquid inlet 72. When the piston moves downwardly, the ball valve member 74 closes the liquid inlet 72 to force liquid up around the stainless steel piston assembly 48 through the upper check valve assembly 44 and into the connecting tubing 16 (FIGS. 1 and 2).

The upper check valve assembly 44 includes a valve seat 80 and a ball valve member 82. The ball valve member 82 prevents liquid from flowing into the liquid chamber 50 from a conduit connected thereto but permits liquid to move through the conduit above the upper check valve assembly 44 where it may be drawn through the connecting tubing 16 to the liquid storage container 18 (FIGS. 1 and 2) without draining back into the gas-operated positive displacement pump 20A.

Figure 4:
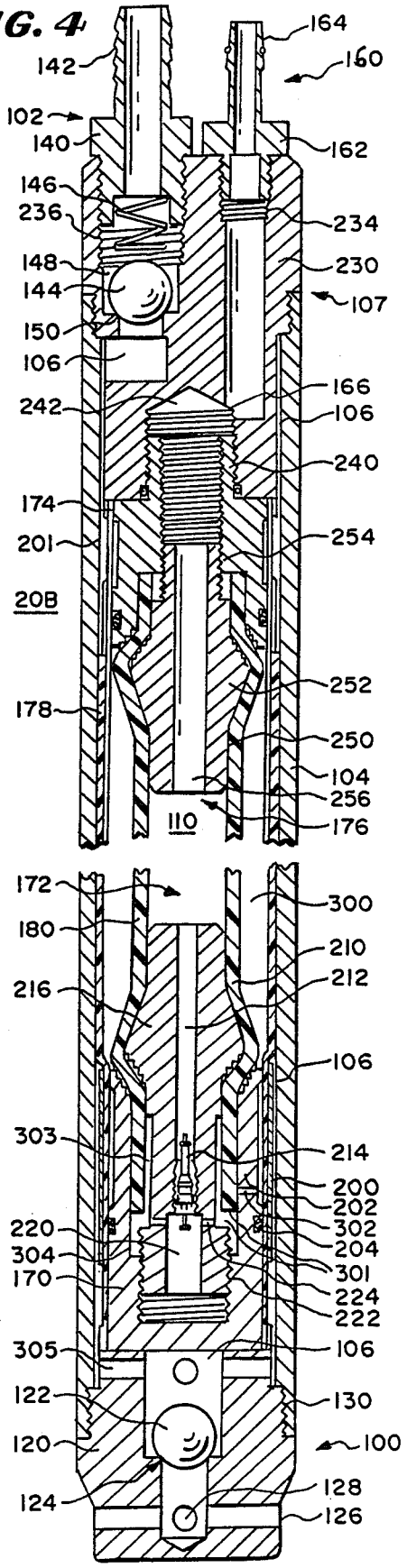
FIG. 4 is a sectional elevational view of another embodiment of pump utilized in the pumping system of FIG. 1.

In FIG. 4, there is shown a sectional view of the preferred embodiment of an air-actuated positive displacement pump 20B having a lower check valve assembly 100, an upper check valve assembly 102, an outer wall 104, a liquid chamber 106, a positive displacement assembly (not numbered in FIG. 4), a pump head 107 and a gas chamber 110. In this embodiment, the positive displacement assembly moves the inner wall of a cylindrical portion of a liquid chamber 106 outwardly upon receiving gas pressure and the positive displacement assembly pulls the wall of the liquid chamber 106 inwardly to expand it upon being relieved of pressure. This causes the liquid chamber 106 to alternately contract in volume and expel liquid through the upper check valve assembly 102 into the connecting tubing 16 (FIGS. 1 and 2) and to expand in volume and draw liquid through the lower check valve assembly 100.

The lower check valve assembly 100 includes a liquid-inlet housing 120, a check valve member 122, a valve seat 124, and a plurality of inlet ports, two of which are shown at 126 and 128, entering the valve seat 124 where they communicate with the liquid chamber 106 through the lower check valve assembly 100. The liquid-inlet housing 120 has external threads 130 which engage complementarily formed internal threads on the end of the outer wall 104 to mount the lower check valve assembly 100 to the outer wall 104.

The upper check valve assembly 102 includes an upper housing 140, a liquid hose connection 142, a check valve element 144, a helical compression spring 146, a check valve cage 148 and a check valve seat 150. The upper liquid housing 140 is threaded into an upper liquid plug assembly 174 and communicates at one end with the liquid chamber 106 and at its other end with the connecting tubing 16C (FIGS. 1 and 2) through the liquid hose connection 142. The check valve element 144 is seated in the outlet port from the liquid chamber 106 to prevent liquid from flowing downwardly from the connecting tubing 16D (FIGS. 1 and 2) into the liquid chamber 106 and is held by the spring 146 from closing the path to the hose 142 when liquid flows through the outlet port of the liquid hose connection 142 which communicates at one end of the outlet port of the liquid chamber 106 (FIGS. 1 and 2).

An air inlet 160 connects the connecting tubing 16B and 16C through the control system 14 and the connecting tubing 16A to the source of gas under pressure 12 (FIG. 1) to apply gas pressure to the gas chamber 110 and relieve the gas pressure to operate the pump. For this purpose, the air inlet 160 includes a housing 162 having at one end a hose connection 164 and at its other end a threaded connection engaging complementary threads in the pump head 107. It communicates within this assembly through an opening 166 with the gas chamber 110.

The positive displacement assembly (not numbered in FIG. 4) includes a lower liquid plug assembly 170, a lower air plug assembly 172, the upper liquid plug assembly 174, an upper air plug assembly 176, an inner liquid chamber cylindrical wall 178 and a gas chamber cylindrical wall 180. The inner liquid chamber cylindrical wall 178 circumscribes the gas chamber cylindrical wall 180 and communicates with the upper and lower liquid plug assemblies 170 and 174. The inner surface of the inner liquid chamber cylindrical wall 178 and the external surface of the gas chamber cylindrical wall 180 form an annular space 300. The gas chamber cylindrical wall 180 is positioned adjacent to the inner liquid chamber cylindrical wall 178 to push and pull it and forms the gas chamber 110 within it.

The inner liquid chamber cylindrical wall 178 is one of two walls forming the liquid chamber 106, the other wall being the inner surface of the outer wall 104 with the inner liquid chamber cylindrical wall 178 being inside and immediately adjacent to the inner surface of the outer wall 104 so that it may move into intimate contact with it to displace liquid from the liquid chamber 106 and move a distance away to fill a portion of the liquid chamber 106. The main active portion of the liquid chamber 106 is thus a cylindrical space formed between the inner surface of the outer wall 104 and the outer surface of the inner liquid chamber cylindrical wall 178.

The inner liquid chamber cylindrical wall 178 should be tubular and able to move a distance from the inner surface of the outer wall 104 which is at least one millimeter and, in some embodiments, may move up to 5 centimeters inwardly to control the amount of liquid that can be displaced. The area of the inner surface of the outer wall 104, forming one side of the liquid chamber 106 may be within a range of 4 square centimeters to 5,000 square centimeters and the volume for full displacement is in the range of 0.4 cubic centimeters to 25 liters.

In the preferred embodiment, the inner liquid chamber cylindrical wall 178 is inert and non-elastomeric and the outer wall 104 is relatively stiff and has an inner surface which is inert. The inner wall of the inner liquid chamber cylindrical wall 178 must be capable of movement but the outer wall 104 should be sufficiently stiff to not stretch substantially under pressure during pumping.

The rigidity of the outer wall 104 as affected by the modulus of elasticity of the materials composing it, its shape and thickness should be greater than the modulus of rigidity of either the inner liquid chamber cylindrical wall 178 or of the gas chamber cylindrical wall 180 of the gas chamber 110 and it must not be strained beyond the yield point of its material. In this specification, an elastomer or an elastomeric material is a material which, at room temperature, can be stretched under low stress to at least twice its original dimensions and, upon immediate release of the stress, will return with force to its approximate original dimensions.

The gas chamber cylindrical wall 180 of the gas chamber 110 is tubular to contain gas pumped in and formed of a material which expands under pressure. This wall must be placed in close contact with the inner liquid chamber cylindrical wall 178 of the liquid chamber 106 so that, when it expands under pressure, it exerts force upon the inner liquid chamber cylindrical wall 178 of the liquid chamber 106 and, when collapsed, can pull the inner liquid chamber cylindrical wall 178 inwardly by vacuum pressure to draw liquid by suction into the liquid chamber 106. The pressure of the pull must be sufficient to draw a substantial quantity of water inwardly under low hydrostatic pressure.

The gas chamber cylindrical wall 180 of the gas chamber 110:(1) must be sufficiently elastomeric to expand against the liquid chamber 106; (2) must be sufficiently resilient to move back with enough force to expand the liquid chamber 106; (3) should be an elastomeric material; (4) in the preferred embodiment, is silicone rubber; (5) may be moved by gas pressure and permitted to retract with a peak force of at least 5 ounces; and (6) has a maximum force of elasticity of 5 ounces.

The lower liquid plug assembly 170 includes a retainer ring 200, a body portion 202, an "O" ring 204. The body portion 202 is generally cylindrical and cup shaped and is in contact with the inlet housing. It includes a central bore tapped at its lower end to permit the insertion of the lower air plug assembly 172.

The cylindrical retainer ring 200 is of metal and holds the inner liquid chamber cylindrical wall 178 of the liquid chamber 106 against the cylindrical body portion 202 in a fluid-tight seal so that liquid passing through the inlet ports 126 and 128 flows upwardly and outside the lower liquid plug assembly 170. The "O" ring 204 provides an additional seal between the lower liquid plug assembly 170 and inlet liquid that might otherwise enter the gas chamber 110.

The lower air plug assembly 172 includes a body portion 210, an air channel 212, a check valve 214 and an annular, radially extending gas wall retaining portion 216. The lower portion of the body portion 210 of the lower air plug assembly 172 includes a counterbore 220 and external circumferential threads 222 engaging corresponding external threads in the bottom of the lower liquid assembly 170.

The counterbore 220 communicates with an external air chamber 301 by an air channel 224 above the external circumferential threads 222 of the body portion 210 of the lower air plug assembly 172. This external air chamber 301: (1) is in communication with an upper air chamber 303 which is formed by a reduction in the outside diameter of the body portion 210 of the lower air plug assembly 172; (2) is formed by the lower portion of the body portion 210 of the lower air plug assembly 172 and by the chamber counterbore 304 of the body portion 202 of the lower liquid plug assembly 170; and (3) is in communication with the annular space 300 by way of the external air channel 302 of the body portion 202 of the lower liquid plug assembly 170 and between the radially extending portion of the gas chamber cylindrical wall 180 and the chamber counterbore 304.

The air channel 212 is a cylindrical centrally located channel communicating at one end with the gas chamber 110 and extending vertically downwardly into the counterbore 220. The check valve 214 is positioned in the air channel 212 to permit air to flow upwardly from the counterbore 220 to the gas chamber 110 but not in the reverse direction.

The gas wall retaining portion 216 of the lower air plug assembly 172 is generally cylindrical at its uppermost portion where the air channel 212 enters it. The gas wall retaining portion 216 extends radially from a mid-portion of the axis passing through the air channel 212 and extends radially therefrom. The check valve 214 is positioned between the counterbore 220 and the top portion of the air channel 212, being within the air channel 212 adjacent to the counterbore 220.

Between the chamber counterbore 304 and the gas wall retaining portion 216, the body portion 210 is generally cylindrical and receives over its external surface the silicone tubing which slants inwardly about the gas wall retaining portion 216 to be pressed against the lower liquid plug assembly 170. The space between this cylindrical portion and the chamber counterbore 304 is sufficient to accommodate the end of the gas chamber cylindrical wall 180 so that it may extend and overlie the external air channel 302. The counterbore 220 lies within a cylindrical externally-threaded portion to be tightly screwed within the lower liquid plug assembly 170 and thus sealed at its bottom end.

The pump head 107 receives the upper liquid plug assembly 174, the air inlet 160, the upper check valve assembly 102 and an air inlet communicating through the upper liquid plug assembly 174 with the upper air plug assembly 176 and the liquid chamber 106.

The pump head 107 includes an outer cylindrical wall 230, a first tapped vertical hole 234 and a second tapped vertical hole 236. The first tapped hole 234 communicates with the gas chamber 110 through the air channel 256 in the upper air plug assembly 176. For this purpose, it is tapped at its upper end to receive the air hose connection 164 through which it alternately receives pressurized gas and atmospheric level pressure. This pressurized gas or atmospheric level pressure is transferred through the upper air plug assembly 176 to the gas chamber 110 for pumping action.

The second tapped vertical hole 236 receives the liquid hose connection 142 and, for that purpose, is threaded at its upper end and has the check valve element 144 at its lower end to permit liquid to move upwardly from the liquid chamber 106 to the hose but not downwardly from the hose to the liquid chamber 106. The liquid chamber 106 extends downwardly past the upper liquid plug assembly 174 into the space between the outer wall 104 and the movable inner liquid chamber cylindrical wall 178 of the liquid chamber 106.

The upper liquid plug assembly 174 includes: (1) an upper cylindrical portion 240 externally tapped to fit within a tapped bore in the pump head 107 and having a space 242 at its upper end communicating through the opening 166 and a central bore in the upper air plug assembly 176; (2) a second enlarged cylindrical side which holds the inner liquid chamber cylindrical wall 178 with a steel retainer 201 in a manner similar to the lower liquid plug assembly 170 to seal the liquid chamber 106 from the gas chamber 110 at both ends of the gas chamber 110; and (3) portions for receiving the gas chamber cylindrical wall 180 along one periphery for compression with the upper air plug assembly 176 in a manner similar to the manner in which the lower liquid plug assembly 170 receives the opposite end of the gas chamber cylindrical wall 180 for compression with the lower air plug assembly 172.

The upper air plug assembly 176 includes an outer cylindrical portion 250, an annular outwardly radiating portion 252 and a threaded cylindrical portion 254 in a manner similar to the lower air plug assembly 172, having a vertically extending longitudinal air passage 256 extending from the space 242 to the air chamber 110 to permit the passage of pressurized gas therethrough. The gas chamber cylindrical wall 180 of the gas chamber 110 at its upper end is also pressed between the annular outwardly radiating portion 252 and the end of the upper liquid plug assembly 174 in a manner similar to the lower end of the gas chamber cylindrical wall 180 being pressed between the gas wall retaining portion 216 of the lower air plug assembly 172 and the end of the lower liquid plug assembly 170 as described above.

Figure 5:
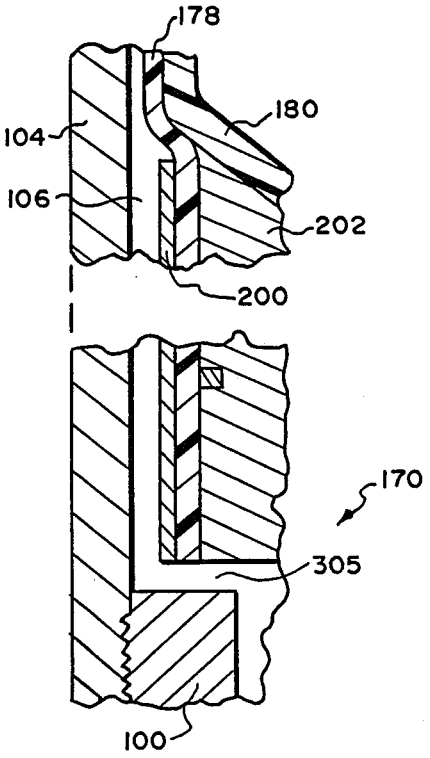
FIG. 5 is an exploded fragmentary sectional view of a portion of the pump of FIG. 1 illustrating the manner in which the liquid chamber communicates with the inlet.

In FIG. 5, there is shown a fragmentary enlarged sectional view of a portion of the liquid chamber 106 where it communicates with the lower check valve assembly 100 through the passages 305 in the lower liquid plug assembly 170, illustrating how the steel retainer ring 200 holds movable outer liquid chamber cylindrical wall 178 of the liquid chamber 106 tightly sealed against the body portion 202 of the lower liquid plug assembly 170 of the liquid chamber 106 to permit fluid to flow between it and the stainless steel outer wall 104 but not between the steel retainer ring 200 or the movable outer wall and the body portion 202.

With this arrangement, liquid flows into the check valve member 122 (FIG. 4) through the inlet ports 126 and 128 into the liquid chamber 106 where it is then forced to flow upwardly through the check valve element 144 into the connecting tubing 16 (FIGS. 1 and 2) as the inner liquid chamber cylindrical wall 178 is first pulled backwardly by vacuum pressure, then expanded by the silicone gas chamber cylindrical wall 180.

Figure 6:
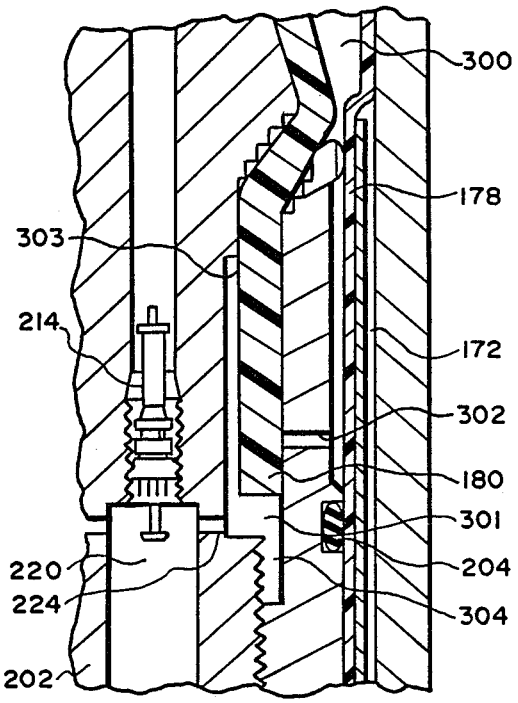
FIG. 6 is an exploded fragmentary sectional view of another portion of the embodiment of FIG. 4 illustrating the manner in which the gas chamber communicates with the gas space between the expandable gas chamber and the liquid chamber to permit the bleeding of gas from that space.

In FIG. 6, there is shown a fragmentary enlarged exploded view of a portion of the lower air plug assembly 172 showing the gas chamber cylindrical wall 180 of the gas chamber 110 (FIG. 4) in its inward position which occurs when the gas chamber 110 is vented to the atmosphere through conduit 16E (FIGS. 1 and 2) and control system 14 (FIG. 1). When the gas chamber 110 (FIG. 4) is at atmospheric pressure, the gas chamber cylindrical wall 180 shown at the top is moved inwardly where it lies against the lower inward surfaces of the upper and lower air plug assemblies 172 and 176 (FIG. 4 shows the gas chamber cylindrical wall 180 in an intermediate position as it moves outwardly to compress the liquid chamber 106 and expel liquid through the upper check valve assembly 102).

As shown in FIG. 6, the lower end of the gas chamber cylindrical wall 180 extends into the chamber counterbore 304, covering the external air channel 302 to block access through the external air channel 302 to the annular space 300 from the external air chamber 301. With this arrangement, gas in the annular space 300 is forced between the inner liquid chamber cylindrical wall 178 and the upper portion of the body portion 202 of the lower liquid plug assembly 170 through the external air channel 302 under the lower end of the gas chamber cylindrical wall 180 and into the external air chamber 301 as the gas chamber cylindrical wall 180 expands during pressurization of gas chamber 110, thus pressurizing the external air chamber 301, the upper air chamber 303 and the counterbore 220 by way of the air channel 224, and also evacuating the annular space 300.

When the gas chamber 110 is vented to atmosphere and the expanded gas chamber cylindrical wall 180 collapses inwardly, vacuum pressure pulls the inner liquid chamber cylindrical chamber wall 178 inwardly to cause suction to draw liquid through the inlet ports 126 and 128 (FIG. 4) and the check valve member 122 into the liquid chamber 106 for later pumping to the upper check valve assembly 102 (FIG. 4). At this time, the external channel 302 is closed by pressure as shown in FIG. 6.

During the venting of the gas chamber 110, the end of the gas chamber cylindrical wall 180 is pulled and pushed by the differential and pressure to close the air channel 302 and prevent the escape of any gas from the external air chamber 301 to a space between the outer gas chamber cylindrical wall 180 and the inner liquid chamber cylindrical wall 178 of the liquid chamber 106 (FIG. 4).

During the venting of gas chamber 110, the pressure in the counterbore 220, external air chamber 301 and upper air chamber 303 is greater than that of the gas chamber 110. This differential pressure opens the check valve 214 which vents this air into the gas chamber 110. Similarly, each pumping cycle purges the annular space 300 between the gas chamber cylindrical wall 180 and the inner liquid chamber cylindrical wall 178.

Since the inner liquid chamber cylindrical wall 178 is non-elastomeric but rather expands by flexure, it is the most prone to failure by cracking. A crack in the inner liquid chamber cylindrical wall 178 permits water to enter the annular space 300 by vacuum pressure. However, this pump reduces problems caused by such cracks as it pumps. These problems are reduced in two ways, which are: (1) by removing water leakage before it interferes with operation; and (2) by indicating failure.

The water leaking into the space 300 is removed, because during pressurization of the gas chamber 110, the water in the annular space 300 is forced through the external air channel 302 into the external air chamber 301 through the air channel 224 into the counterbore 220. The level of water continues to rise until it reaches the check valve 214. Since at this point there is still a volume above the water level (the upper air chamber 303), the upper air chamber 303 is gas filled which is compressible and drives water through the check valve 214 into the gas chamber 110 upon venting of gas chamber 110. This water is air lifted through the upper air plug assembly 176, pump head 107, air inlet 160, through the connecting tubing 16B and 16C and through the control system 14 of FIG. 2, and is exhausted to the atmosphere. This water being exhausted provides an indication of failure of the inner liquid chamber cylindrical wall 178 without contamination of the liquid sample with pumping air or air borne contaminants.

Figure 7:
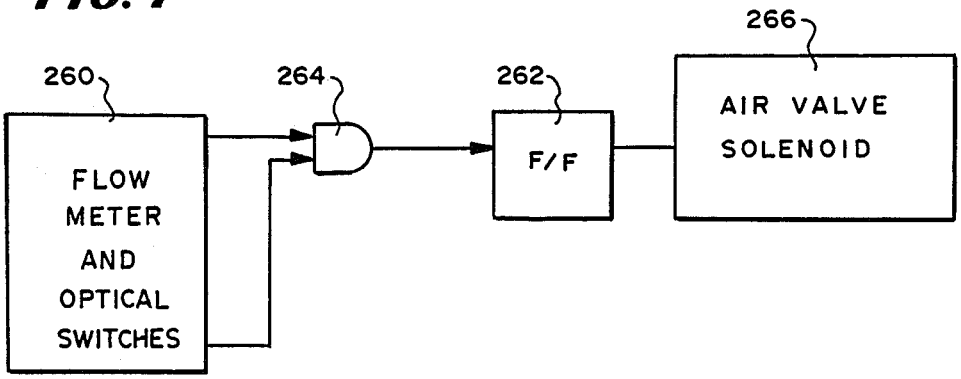
FIG. 7 is a block diagram of a control system for controlling the application and removal of gas pressure from the gas chamber of the pump utilized in FIG. 1.

In FIG. 7, there is shown a block diagram of a control system 14 (FIG. 4) adapted to open the conduit 16E (FIG. 1) to the air or connect the connecting tubing 16B (FIG. 1) to the connecting tubing 16A to pressurize the gas-operated positive displacement pump 20. For this purpose, the control system 14 includes a flow meter 260, a bistable switch 262, an AND gate 264, and a solenoid air valve 266. This is an illustrative block diagram of circuits which are available on the market, one of which has been sold by Isco, Inc., 531 Westgate Boulevard, Lincoln, Neb., under the designation Model 2600 Control Unit PCB Assembly, 60-2604-020 and Case Assembly 60-2604-019.

The flow meter 260 may be of any type but, in the preferred embodiment, a piston is spring-biased to be moved to one extreme or the other under gas flow or differential pressure and to be stationary in a known location at rest. The position of the piston is sensed with flow sensors which may be either optical sensors or magnetically activated reed switches. The bistable switch 262 receives signals from the flow sensors through the AND gate 264 indicating that the piston has been moved by the flow of air either pressurizing the pump or leaving the pump in a vent operation. Each time the piston is sensed as having been moved to the flow direction, the bistable switch 262 is clocked, and the solenoid air valve 266 is switched, the bistable switch 262 is reset.

The flow sensors of the flow meter for rest position are connected through an AND gate 264 to the clock terminal of the bistable switch 262 and the solenoid air valve 266 so that each time the piston moves showing a flow of air, the bistable switch 262 is clocked and when the piston returns indicating either full venting or full expansion of the gas chamber 110, the solenoid air valve 266 is switched to its opposite position. The output from the AND gate 264 clocks the bistable switch 262. Obviously, other flow meters may be used and other detectors available in the prior art to switch the solenoid air valve 266.

Prior to using gas-operated displacement pump 20, it may be disassembled, inspected, cleaned or repaired and then reassembled. It is disassembled by unscrewing the liquid hose connection 142 and removing the check valve element 144. Similarly, the air hose connection 164 may be removed from the pump head 107. Once this is done: (1) the pump head 107 may be unscrewed from the outer wall 104; (2) the upper liquid plug assembly 174 may be unscrewed and removed; (3) the upper air plug assembly 176, the lower air plug assembly 172 and lower liquid plug assembly 170 may be removed together with the gas chamber cylindrical wall 180 as an assembly for inspection; (4) the interior of the housing and the removed assembly may be inspected; and (5) the inlet unscrewed from the outer wall 104 for inspecting and removal of the check valve member 122.

After inspection and maintenance, the gas-operated positive displacement pump 20 may be assembled by replacing: (1) the check valve member 122 and screwing the inlet back in place; (2) the inner liquid chamber cylindrical wall 178; (3) the gas chamber cylindrical wall 180, upper and lower air plug assemblies 172 and 176, and lower liquid plug assembly 170 and the upper liquid plug assembly 174 as a unit; (4) the pump head; (5) the check valve element 144; (6) the liquid hose connection 142; and (7) the air hose connection 164 threaded back into place.

At the site, the outlet tubing 16D (FIG. 2) is connected to the liquid hose connection 142 at one end and to the liquid storage container 18 (FIG. 2) at the other end and the air hose is connected to the air hose connection 164, and through the connecting tubing 16B and 16C to the control system 14 so that the flow of air there through may be measured. The control system 14 (FIG. 2) connected to the pressurized source of gas 12 to be controlled thereby.

In operation, the gas chamber 110 is alternately pressurized by air and depressurized, driving air from the space between its outer gas chamber cylindrical wall 180 and the inner liquid chamber cylindrical wall 178 of the liquid chamber 106 so that the inner liquid chamber cylindrical wall 178 is alternately pulled inwardly and pushed outwardly to draw liquid through the lower check valve assembly 100 and expel it through the upper check valve assembly 102.

More specifically, when the pump is at rest as shown in FIG. 4, there is a space between the outer gas chamber cylindrical wall 180 of the gas chamber 110 and the inner liquid chamber cylindrical wall 178 of the liquid chamber 106. Initially, pressurized air flows through the air inlet 160, through the first tapped hole 234 and the opening 166, and the air passage 256 into the gas chamber 110 to expand the gas chamber cylindrical wall 180 outwardly against the inner liquid chamber cylindrical wall 178 of the liquid chamber 106.

As the gas chamber cylindrical wall 180 is stretched outwardly in the direction of the inner liquid chamber cylindrical wall 178 of the liquid chamber 106, its outer wall is initially separated from the inner wall of the inner liquid chamber cylindrical wall 178 of the liquid chamber 106 by air. This air becomes compressed as the gas chamber cylindrical wall 180 moves outwardly under pressure of gas in the gas chamber 110 causing it to flow between the inner liquid chamber cylindrical wall 178 and the upper portion of the body portion 202 of the lower liquid plug assembly 170 through the external air channel 302 under the lower end of the gas chamber cylindrical wall 180 and into the external air chamber 301, thus pressurizing the external chamber 301, the upper air chamber 303 and the counterbore 220.

As the gas chamber cylindrical wall 180 moves the inner liquid chamber cylindrical wall 178 outwardly, expelling liquid through the check valve and into the outlet port at the liquid hose connection 102, the flow meter 260 (FIG. 7) senses the movement from the rest position of the piston and clocks the bistable switch 262 (FIG. 7).

When the gas chamber cylindrical wall 180 has been moved by pressure in the gas chamber 110 flat against the inner liquid chamber cylindrical wall 178, the flow meter 260 senses that air flow has stopped, indicating the full expansion of the gas chamber 110, and sends a signal to the AND gate 264 indicating the piston has returned to its biased no-flow position, thus clocking the bistable switch 262 and causing the solenoid air valve 266 to vent the air inlet 160 to atmosphere.

When the air inlet 160 is vented to atmosphere, the outer gas chamber cylindrical wall 180, which has been stretched by air in the gas chamber 110, begins snapping back under elastic force. Because air has been exhausted between it and the inner liquid chamber cylindrical wall 178, which cannot be filled because the lower end of the gas chamber cylindrical wall is over the external air channel 302, it pulls the inner liquid chamber cylindrical wall 178 inwardly with it.

Although the check valve 214 restrains air from flowing from the gas chamber 110 back between the gas chamber cylindrical wall 180 and the inner liquid chamber cylindrical wall 178, the end of the gas chamber cylindrical wall 180 also closes the external air channel 302.

As the gas chamber cylindrical wall 180 pulls the inner liquid chamber cylindrical wall 178 away from the inner surface of the stainless steel outer wall 104, liquid is drawn through the upper check valve assembly 102 through inlet ports 126 and 128, lifting the check valve member 122 and flowing through the passage 305 into the space between the gas chamber cylindrical wall 180 and the inner liquid chamber cylindrical wall 178.

When the control system 14 senses the movement of gas from the gas chamber 110, it clocks the bistable switch 262. When it senses the stop of the flow of air through the air outlet to atmosphere, it again signals the solenoid through AND gate 264 and bistable switch 262 to switch the valve into communication with the pressurized source of air. This begins a new cycle by expanding the pressurized gas chamber 110 outwardly to expel water from the liquid chamber 106 through the check valve element 144 into the liquid hose connection 142 and through the outlet tubing 16D into the liquid storage container 18.

While the pump of this invention has been described as being effective in wells, it is also useful in pumping other fluids. For example, because it has no electrically driven parts or parts likely to create sparks in region of the liquid to be pumped, it is useful in removing explosive liquids such as from tanks. Moreover, it may be used to pump gases instead of liquids. In some such uses, parts may be used which are not as inert as or have different reactive characteristics for the liquid chamber walls.

It is also possible to include the liquid chamber inside the gas chamber with at least a portion of an inner wall of the gas chamber being stretched toward an outer wall of the liquid chamber to squeeze the liquid chamber and thus expell liquid. When air is released from the air chamber, the movable wall of the air chamber retracts and draws the movable wall of the liquid chamber outwardly by vacuum pressure to pull liquid into the liquid chamber.

As can be understood from the above description, the gas-operated positive displacement pump of this invention has several advantages such as: (1) it is simple in construction, containing few movable parts; (2) it is capable of high rates of pumping; (3) it is durable with few wearing parts; (4) it is capable of pumping without a large hydrostatic pressure since it is capable of drawing liquid into the liquid cylinder as well as forcing liquid out of the liquid cylinder; and (5) the liquid cylinder may be composed of inert materials such as stainless steel or polyfluoroethylene.

Although a preferred embodiment of the invention has been described with some particularity, many modifications and variations may be made in the preferred embodiment without deviating from the invention. Therefore, it is to be understood that, within the scope of the appended claims, the invention may be practiced other than as specifically described.

What is claimed is:

1. A gas-operated positive displacement pump comprising:

liquid inlet means for receiving liquid into said pump;

liquid outlet means permitting liquid to be pumped from said pump;

gas communication means for permitting the entering and exiting of gas from said pump, whereby said pump may be actuated to pump liquid into said inlet and out of said outlet;

liquid chamber means having walls confining a liquid;

one of the walls of said liquid confining means being movable;

first gas chamber means having walls for confining gas;

at least one wall of said first gas chamber means being movable and biased away from the other wall whereby said at least one wall of said gas chamber may be moved by gas pressure toward said one of the walls of said liquid confining means and permitted to move away from said one of the walls of said liquid confining means;

second gas chamber means for receiving gas from between said one of the walls of said liquid confining means and one wall of said first gas chamber;

means connecting said second gas chamber and a space between said one of the walls of said liquid confining means and one wall of said first gas chamber for permitting gas to move only from said space to said second gas chamber;

means connecting said second and first gas chambers for permitting gas to move only from said second gas chamber to said first gas chamber; and means for causing the movement of said at least one wall of said first gas chamber to move said movable wall of said liquid chamber in a direction that expands said liquid chamber.

2. A method of pumping comprising the steps of:

immersing a liquid inlet means of a pump in a liquid to be pumped;

connecting one end of a hose to a liquid outlet means of said pump;

placing the other end of said hose at a location to which the liquid is to be pumped;

connecting a hose to a gas communication means for permitting the entering and exiting of gas from first gas chamber means in said pump having walls confining a liquid, wherein at least one of the walls of a gas chamber and said liquid confining means are movable;

moving the movable wall of the liquid chamber toward the other wall by moving said gas chamber wall in the direction of the movable wall of liquid chamber whereby the movement of said gas chamber wall moves said movable wall of said liquid chamber;

permitting air between the movable walls of said gas chamber and liquid chamber to move into a second gas chamber but not back between the movable walls; and permitting the air in said second gas chamber to move into said first gas chamber but not back to the second gas chamber.

3. A gas-operated positive displacement pump comprising:

liquid inlet means for receiving liquid into said pump;

liquid outlet means permitting liquid to be pumped from said pump;

gas communication means for permitting the entering and exiting of gas from said pump, whereby said pump may be actuated to pump liquid into said inlet and out of said outlet;

liquid chamber means having walls confining a liquid;

one of the walls of said liquid confining means being movable;

gas chamber means having walls for confining gas;

at least one wall of said gas chamber means being movable and biased to retract whereby said at least one wall of said gas chamber means may be moved by gas pressure and permitted to retract with a peak force of at least 5 ounces;

means for causing the movement of said at least one wall of said gas chamber to move said movable wall of said liquid chamber in a direction that expands said liquid chamber;

said at least one wall of said gas chamber being an elastomeric wall having greater elastically than said movable wall;

means for providing communication between the space between said movable wall and said elastomeric wall while said elastomeric wall is expanding, whereby air between said movable wall and elastomeric wall may enter said air chamber and for preventing communication of the space between said elastomeric wall and movable wall while said elastomeric wall is contracting, whereby said movable wall is pulled with said elastomeric wall to expand said liquid chamber.

4. A pump in accordance with claim 3 in which said movable wall is capable of moving a predetermined distance within the range of 1 millimeter to 5 centimeters.

5. A gas-operated positive displacement pump comprising:

liquid inlet means for receiving liquid into said pump;

liquid outlet means permitting liquid to be pumped from said pump;

gas communication means for permitting the entering and exiting of gas from said pump, whereby said pump may be actuated to pump liquid into said inlet and out of said outlet;

liquid chamber means having walls confining a liquid;

one of the walls of said liquid confining means being movable;

gas chamber means having walls for confining gas;

at least one wall of said gas chamber means being movable and biased to retract whereby said at least one wall of said gas chamber means may be moved by gas pressure and permitted to retract with a peak force of at least 5 ounces;

means for causing the movement of said at least one wall of said gas chamber to move said movable wall of said liquid chamber in a direction that expands said liquid chamber;

said at least one wall of said gas chamber being an elastomeric wall having greater elasticity than said movable wall;

said movable wall being formed of polytetrafluoroethylene;

said liquid chamber having a rigid wall; and said rigid wall having at least one surface of stainless steel facing said polytetrafluoroethylene wall.

6. A pump according to claim 5 further including means for providing communication between the space between said movable wall and said elastomeric wall while said elastomeric wall is expanding, whereby air between said movable wall and elastomeric wall may enter said air chamber and for preventing communication of the space between said elastomeric wall and movable wall while said elastomeric wall is contracting, whereby said movable wall is pulled with said elastomeric wall to expand said liquid chamber.

7. A pump in accordance with claim 6 in which said movable wall is capable of moving a predetermined distance within the range of 1 millimeter to 5 centimeters.

8. A pump in accordance with claim 7 in which the surface area of said movable wall capable of contacting said rigid wall of said liquid chamber is in a range of between 4 square centimeters and 5,000 square centimeters.

9. A pump in accordance with claim 8 in which the volume of said liquid chamber is in the range of between 0.4 cubic centimeters to 25 liters.

10. A pump in accordance with claim 9 in which the maximum force of elasticity of said elastomeric member is 5 ounces.

11. A pump in accordance with claim 10 in which said rigid wall is a cylinder; said movable inner wall is a cylinder inside and circumscribed by said rigid outer wall and said elastomeric wall is a cylinder inside and circumscribed by said movable wall.

12. A method of pumping comprising the steps of:

immersing a liquid inlet means of a pump in a liquid to be pumped;

connecting one end of a hose to a liquid outlet means of said pump;

placing the other end of said hose at a location to which the liquid is to be pumped;

connecting a hose to a gas communication means for permitting the entering and exiting of gas from an expandable gas expansion chamber having an elastomeric wall in said pump located in the center of a liquid chamber which has walls confining a liquid, wherein one of the walls of said liquid chamber is movable;

moving the movable wall of the liquid chamber toward an outer wall by expanding said gas chamber whereby the movement of said elastomeric wall moves said movable wall; moving the movable wall includes the step of moving a polytetrafluoroethylene against a rigid wall having at least one surface of stainless steel facing said polytetrafluoroethylene wall; and providing communication between the space between said movable wall and said elastomeric wall while said elastomeric wall is expanding, whereby air between said movable wall and elastomeric wall may enter said air chamber and preventing communication of the space between said elastomeric wall and movable wall while said elastomeric wall is contracting, whereby said movable wall is pulled with said elastomeric wall to expand said liquid chamber.

13. A method in accordance with claim 12 further including the step of moving a predetermined distance within the range of 1 millimeter to 5 centimeters.

14. A method in accordance with claim 13 in which the step of moving includes the step of moving a wall having a surface area contacting said rigid wall of said liquid chamber in a range of between 4 square centimeters and 5,000 square centimeters.

15. A method in accordance with claim 14 in which the step of forcing liquid from said liquid chamber includes the step of forcing liquid in the range of between 0.4 cubic centimeters to 25 liters from said liquid chamber during each stroke of the pump.

16. A method according to claim 15 further including the steps of removing one of said inlet and outlet means, removing said expandable gas chamber from said housing, cleaning said pump, reassembling said pump and repeatedly expanding and contracting said chamber to pump liquid.

17. A method according to claim 16 in which said expandable chamber is pressurized starting when said liquid chamber is fully expanded to its maximum and vented to a lower pressure starting when said liquid chamber is at its minimum expansion.

* * * * *